US008456255B2

(12) United States Patent
Iluz

(10) Patent No.: US 8,456,255 B2
(45) Date of Patent: Jun. 4, 2013

(54) VARIABLE PHASE SHIFTER COMPRISING TWO FINITE COUPLING STRIPS COUPLED TO A BRANCH LINE COUPLER

(75) Inventor: Zeev Iluz, Gan-Yavne (IL)

(73) Assignee: Sparkmotion Inc., Ottawa (CA)

( * ) Notice: Subject to any disclaimer, the term of this patent is extended or adjusted under 35 U.S.C. 154(b) by 233 days.

(21) Appl. No.: 12/773,589

(22) Filed: May 4, 2010

(65) Prior Publication Data

US 2011/0273244 A1 Nov. 10, 2011

(51) Int. Cl.
*H01P 1/18* (2006.01)

(52) U.S. Cl.
USPC ..... 333/161; 333/117; 342/375

(58) Field of Classification Search
USPC ..... 333/164, 139, 156, 161, 111, 116, 333/117; 342/372, 375
See application file for complete search history.

(56) References Cited

U.S. PATENT DOCUMENTS

| | | | | |
|---|---|---|---|---|
| 3,146,413 | A * | 8/1964 | Butler | 333/161 |
| 6,208,222 | B1 * | 3/2001 | Sinsky | 333/161 |
| 6,831,602 | B2 * | 12/2004 | McKinzie et al. | 342/375 |
| 2005/0184827 | A1 * | 8/2005 | Pallone et al. | 333/161 |
| 2008/0297273 | A1 * | 12/2008 | Murano | 333/161 |

* cited by examiner

*Primary Examiner* — Benny Lee
(74) *Attorney, Agent, or Firm* — Procopio, Cory, Hargreaves & Savitch LLP

(57) ABSTRACT

A variable phase shifter comprising a coupler including an input port, an output port, a through port and a coupled port and two conducting finite strips exhibiting equal lengths, the first conducting strip being movably coupled with the section of the coupler connecting the input port with the through port and the second conducting strip being movably coupled with the section of the coupler connecting the output port and with the coupled port, wherein displacing the conducting strip relative to the coupler, changes the phase of an output signal from the coupler, relative to the phase of a corresponding input signal into the coupler.

19 Claims, 15 Drawing Sheets

PHASE vs. DISPLACEMENT OF STRIPS AT 3.5 GHz

400

VARIABLE PHASE SHIFTER COMPRISING TWO FINITE COUPLING STRIPS COUPLED TO A BRANCH LINE COUPLER

FIELD OF THE DISCLOSED INVENTION

The disclosed invention relates to phase shifters, in general, and to passive element variable phase shifters in particular.

BACKGROUND

Passive element phase shifters are employed in radio frequency (herein abbreviated RF) transmitters for shifting the phase of a transmitted signal. One application of such phase shifters is, for example, in shifting the phase of a signal provided to each antenna in an antenna array. For example, in cellular networks, where a base station receives and transmits signals to mobile devices in a geographical cell associated with that base station, antenna arrays are used for vertically tilting downward the pattern of the electromagnetic radiation of the base station antenna, to reduce interference with neighboring cells. The phase of the signal provided to each antenna is thus shifted (i.e., relative to a reference phase) according to the required angle of tilt. The antenna array may be used to direct the beam of electromagnetic wave in a desired horizontal direction as well.

U.S. Pat. No. 5,128,639 to Ueda et al, entitled "Phase Shifter Utilizing Hybrid Element" is directed to a phase shifter, which includes a hybrid element and two phase shift regulating circuits. The hybrid element includes an input terminal, an output terminal, a coupling terminal and a through terminal. Each phase shift regulating circuit includes a distributed constant line having a characteristic impedance exceeding 50 ohms and a Field Effect Transistor (FET) switch with the gate thereof connected with a resistor. Each phase shift regulating circuit is connected respectively with the coupling and through terminals of the hybrid element.

In such an arrangement, a signal applied to the input terminal is divided and directed into the coupling and through terminals of the hybrid element. After the signals outputted from these terminals are phase shifted respectively by the respective phase shift regulating circuit, they are combined with each other and taken out of the output terminal. The amount of phase shift is determined by changes of impedance in the circuit comprising the distributed constant line and the FET switch, which appear when the FET switch is turned ON and OFF. A differential phase between the ON and OFF states of the FET switch can be set at any desired level by selecting the length of the distributed constant line.

U.S. Pat. No. 7,233,217 B2 to Phillips et al., entitled "Microstrip phase shifter" is directed to a phase shifter for adjusting the electrical phase of RF signals in a high power and multi-carrier environment. The phase shifter includes a coupling arm and support architecture. The coupling arm includes a coupling ring, a wiper element, a mid-portion, a plurality of support traces, a dielectric support, an aperture, two wing portions and an arm portion. The support architecture fastens the phase shifter to a planar surface while permitting rotation of the wiper element relative to the planar surface. The planar surface includes a plurality of support traces, a first feed line and a second feed line. The second feed line includes a shaped feed line portion that corresponds with the shape of the wiper element of the coupling arm. The shaped feed line portion includes a first portion and a second portion. The location of the support traces positioned on the planar surface corresponds with the location of the support traces located on the wing portions of the coupling arm. The dielectric spacer is positioned between the coupling arm and the feed lines disposed on the planar surface. The coupling ring, the wiper element and the mid-portion have an electric length that is approximately a quarter wavelength of the propagating signal in a circuit.

The feed lines engage with the coupling ring and with the wiper element. The wiper element is capacitively coupled to the shaped feed line portion. The coupling arm is rotated via a key, interacting with a shaft, which is inserted through the aperture. As the coupling arm rotates with the wiper element they both traverse different feed lines. The phase shifter employs capacitive coupling between the moving parts. Particularly, capacitive junctions are formed between a first combination of elements that includes the wiper element, the dielectric spacer and the shaped feed line portion, and a second combination of elements that includes the conductive ring of the coupling arm, the dielectric spacer and the first feed line. The dielectric spacer prohibits a direct current path from forming between conductive elements on the coupling arm and portions of the feed lines. The capacitive junctions facilitate the transfer of an input RF signal from the phase shifter to the outputs of the first and second portions of the shaped feed line portion. The phase shifter adjusts the phase between signals in two RF feed lines by changing the electrical path lengths that RF energy travels down each respective RF feed line.

U.S. Pat. No. 7,301,422 to Zimmerman et al., entitled "Variable Differential Phase Shifter Having a Divider Wiper Arm" is directed to a phase shifter, which includes three conductive strips on PCB board 10. An input signal is supplied to the middle conductive strip and fed to a coupling point. A wiper arm is pivotally connected to the coupling point. The wiper arm includes a Wilkinson divider having quarter wavelength arms with conductive strips extending laterally from these arms. The wiper arm is rotatable about a pivot coupler. The conductive strips of the Wilkinson divider are movable with respect to the other two conductive strips on the PCB board to vary an effective path length from the Wilkinson divider to the output ports of the other two conductive strips.

BRIEF SUMMARY OF THE INVENTION

A novel phase shifter for continuously shifting the phase of a signal over a required range can overcome disadvantages of the prior art.

There is thus provided a variable phase shifter, which includes a coupler and two conducting finite strips. The coupler includes an input port, an output port, a through port and a coupled port. The conducting finite strips exhibit equal lengths. The first conducting strip is movably coupled with the section of the coupler connecting the input port with the through port. The second conducting strip is movably coupled with the section of the coupler connecting the output port and with the coupled port. Displacing the conducting strips relative to the coupler, changes the phase of an output signal from the coupler, relative to the phase of a corresponding input signal into said coupler.

There is also provided a variable phase shifter array. The variable phase shifter array includes at least a first variable phase shifter and a second variable phase shifter. Each the first and the second variable phase shifters shifts the phase of an input signal by a phase shift corresponding thereto. Each of the first and the second variable phase shifters includes a coupler and two conducting finite strips. The coupler includes an input port, an output port, a through port and a coupled port. The conducting finite strips exhibit equal lengths. The first conducting strip is movably coupled with the section of the coupler connecting the input port with the through port. The second conducting strip is movably coupled with the section of the coupler connecting the output port and with the coupled port. Displacing the conducting strips relative to the coupler, changes the phase of an output signal from the coupler, relative to the phase of a corresponding input signal into said coupler.

BRIEF DESCRIPTION OF THE DRAWINGS

The disclosed invention will be understood and appreciated more fully from the following detailed description taken in conjunction with the drawings in which.

DETAILED DESCRIPTION OF THE PREFERRED EMBODIMENTS

Disadvantages of the prior art are overcome by a phase shifter, for continuously shifting the phase of a signal over a required range (e.g., from 0 to 360 degrees). The variable phase shifter is selected from the group consisting of a micro-strip coupler, a strip-line coupler, and a co-planar waveguide coupler. The variable phase shifter includes a coupler (e.g., a quadrature hybrid coupler or any other type of branch line coupler) made of a conducting material and two strips, which are also made of a conducting material. Hereinafter, these two strips will be referred to as the 'conducting strips'. Displacing the conducting strip relative to said coupler, changes the phase of an output signal from the coupler, relative to the phase of a corresponding input signal into the coupler. The length of the conducting strips is related to the required range of the phase shift. Each conducting strip is movable over a corresponding section of the coupler. The phase shift between the input signal and the output signal is related to the displacement of the conducting strips relative to the coupler. For example, for shifting the phase by up to 180 degrees, the length of each conducting strip is $\lambda/4$, where $\lambda$ represents the wavelength corresponding to the center operating frequency (e.g., carrier frequency). Thus, a signal with a carrier frequency of 1 GHz (i.e., one gigahertz) propagating at the speed of light has a wavelength of 0.3 meters. Therefore, the length of the conducting strips would be 0.075 meters. Each one of the conducting strips is movably coupled with a corresponding through port and coupled port of the coupler as further explained herein below. In an initial position, the conducting strips completely overlap with the corresponding sections of the coupler, and do not extend beyond the corresponding port thereof. In this initial position an output signal of the phase shifter remains in-phase (i.e., 0 degrees phase shift) with an input signal provided to the phase shifter. When the conducting strips are displaced relative to the coupler, for example, a length of $\lambda/4$ beyond the corresponding impeding port thereof, the input signal is out-of-phase (i.e., 180 degrees phase shift) relative to the output signal of the phase shifter. The phase of the output signal, relative to the input signal, varies linearly with the displacement of the conducting strips. In addition, the width of the conducting strips may vary lengthwise, thereby changing the rate of change of the relative phase between the input signal and the output signal relative to the displacement of the conducting strips, as explained further below.

Figure 1A:
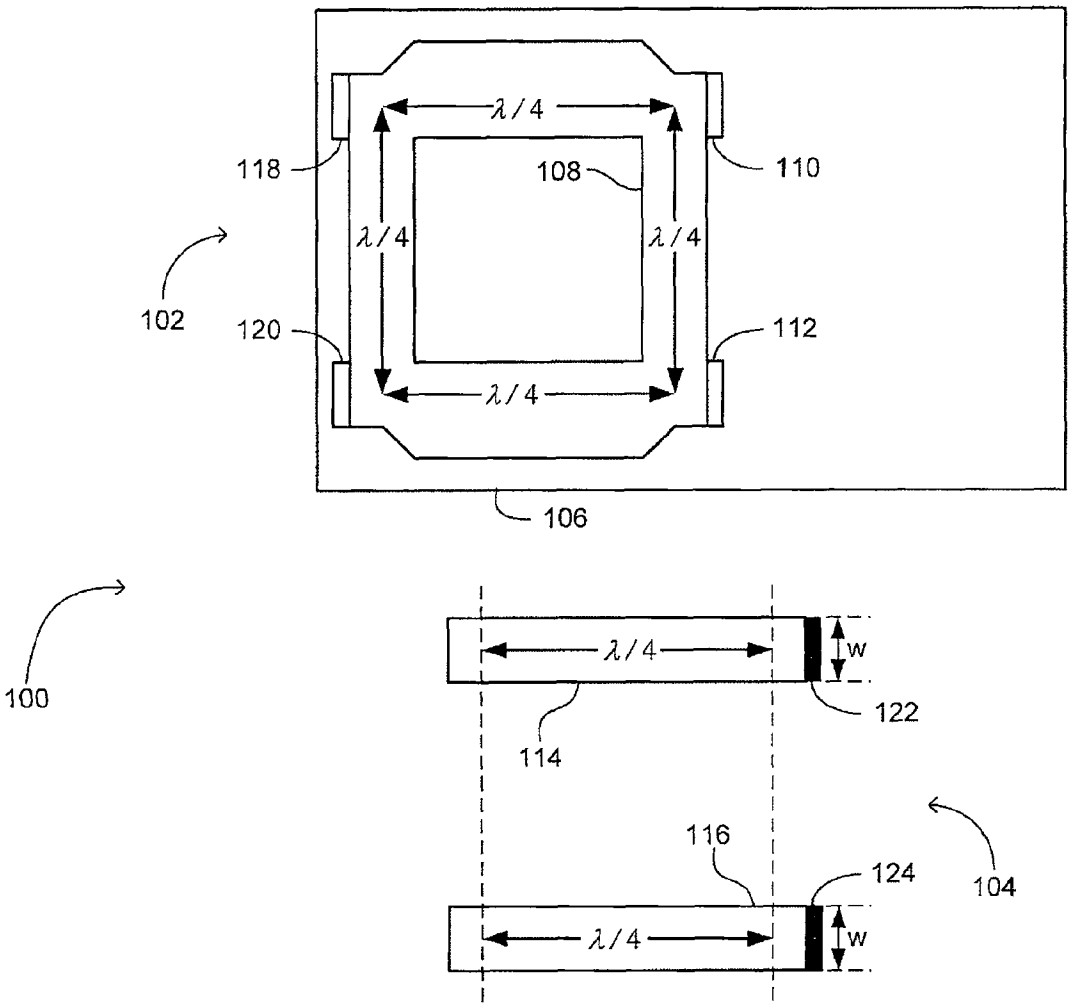
FIG. 1A is a schematic illustration of a variable phase shifter, constructed and operative in accordance with an embodiment of the disclosed invention in a disassembled state.
Figure 1B:
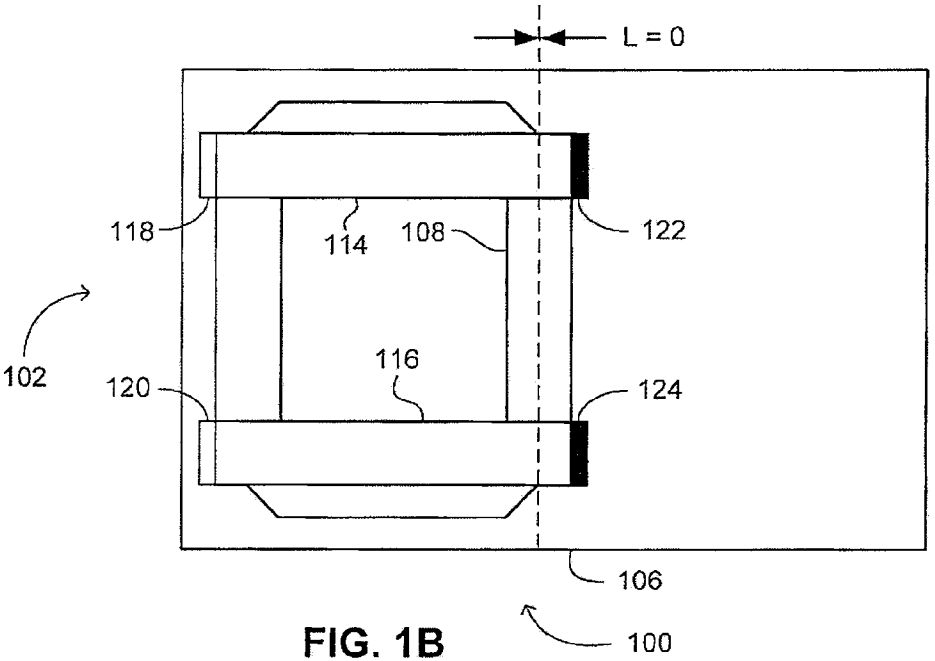
FIGS. 1B, 1D and 1F are schematic illustration of top views of the phase shifter of FIG. 1A at different states of operation.
Figure 1C:
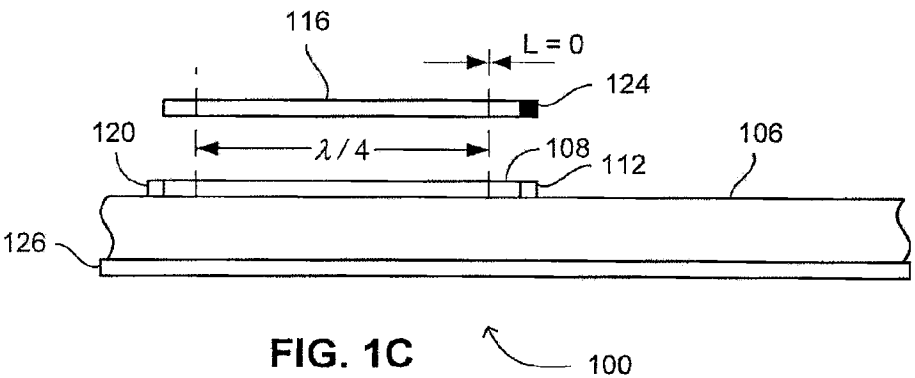
FIGS. 1C, 1E and 1G are schematic illustration of side views of the phase shifter of FIG. 1A at different states of operation.

Reference is now made to FIGS. 1A-1G, which are schematic illustrations of a variable phase shifter, generally referenced 100, constructed and operative in accordance with an embodiment of the disclosed invention. FIG. 1A depicts phase shifter 100 in a disassembled state. Phase shifter 100 includes a static section 102 (FIGS. 1A and 1B) and a movable section 104. Static section 102 includes a substrate 106 and a coupler 108. Substrate 106 is made of a dielectric material. One side of substrate 106 is coated with a layer of metal 126 (FIGS. 1C, 1E, and 1G) connected to ground, thereby creating a ground plane. Coupler 108 includes a through port 110 (FIGS. 1A, 1D, and 1F), a coupled port 112 (FIGS. 1A, 1C-1G), an input port 118 (FIGS. 1A, 1B, 1D and 1F) and an output port 120. Input port 118 may be a signal inlet, which is to be coupled with a signal source. Output port 120 may be a signal outlet. In some coupler configuration (e.g., quadrature hybrid coupler), the roles of input port 118 and output port 120 may be reversed. Through port 110 and coupled port 112 are both open circuited. In FIGS. 1A-1G, coupler 108 is embodied as a quadrature hybrid coupler. Accordingly, the length of each side of coupler 108 is $\lambda/4$ (FIGS. 1A and 1C). Coupler 108 may be, for example, a micro-strip coupler, a strip-line coupler or a co-planar waveguide coupler. Substrate 106 (e.g., a Printed Circuit Board) provides mechanical supports to coupler 108. Coupler 108 is coupled with substrate 106 on the side opposite to metal layer 126. Movable section 104 includes two conducting strips 114, (FIGS. 1A, 1B, 1D and 1F) 116. As mentioned above, the length of conducting strips 114 and 116 is related to the required phase shift range. In FIGS. 1A-1G, each one of conducting strip 114 and 116 is of length λ/4 (FIG. 1A) and width W (FIG. 1A). Conducting strip 114 and 116 are both terminated with either an open circuit or a short circuit 122 (FIGS. 1A, 1B, 1D, 1F) and 124 respectively. Thus, through port 110 and coupled ports 112 are terminated by equal reflective elements created by conducting strips 114 and 116 respectively.

Figure 1E:
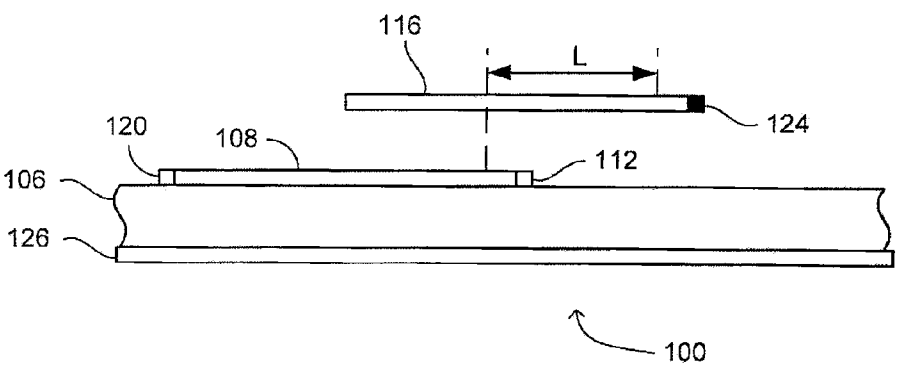
Figure 1D:
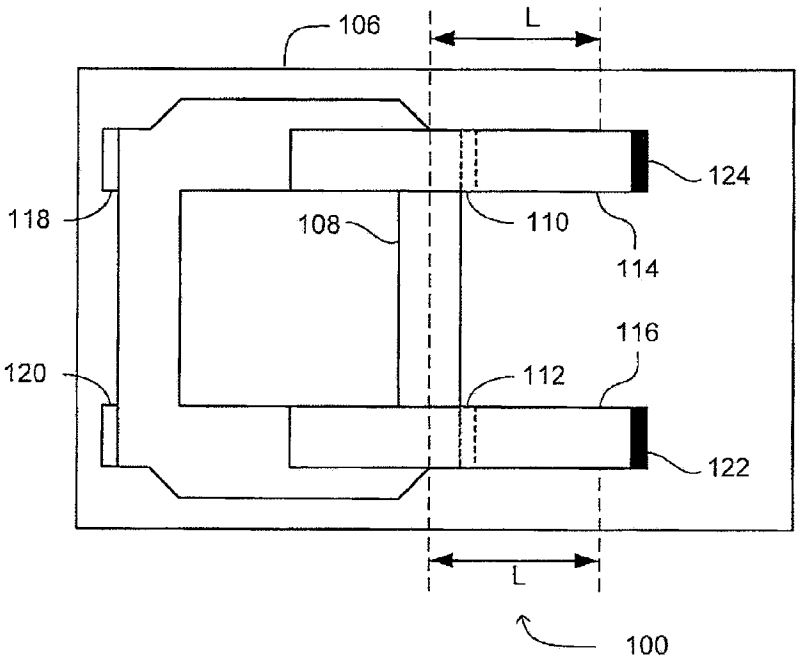
Figure 1F:
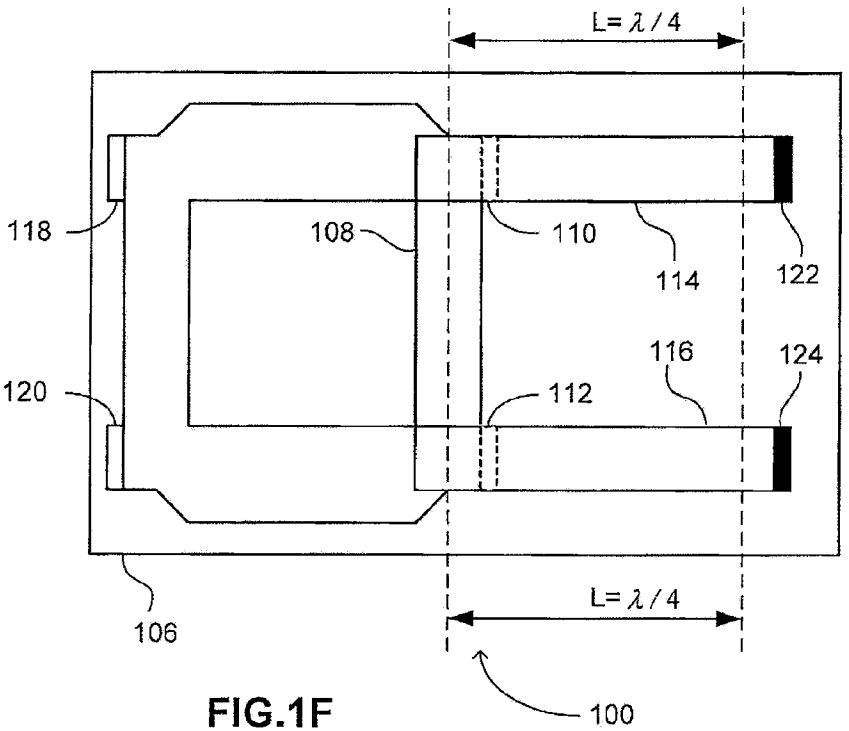
Figure 1G:
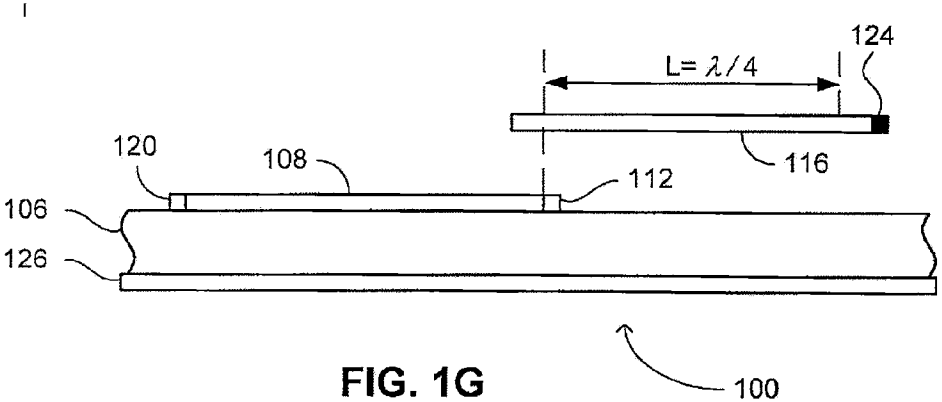

FIGS. 1B-1G depict phase shifter 100 in an assembled state at different states of operation. FIGS. 1B, 1D and 1F depict top views of phase shifter 100 and FIGS. 1C, 1E and 1G depict side views of phase shifter 100 at different states of operation, as further explained below. In FIGS. 1B-1G, conducting strip 114 is movably coupled with the section of coupler 108, which connects input port 118 with through port 110, and conducting strip 116 is movably coupled with the section of 108, which connects output port 120 with coupled port 112. Furthermore, conducting strips 114 and 116 are coupled to a movable mechanical support made of dielectric material (not shown). In FIGS. 1B and 1C, conducting strips 114 and 116 are in an initial position. In this initial position conducting strips 114 and 116 coincide with the respective opposite section of coupler 108. Conducting strip 114 coincide with the section of coupler 108 which connects input port 118 with through port 110 and conducting strip 116 overlap with the section of coupler 108 which connects output port 120 with coupled port 112. Furthermore, conducting strips 114 and 116 do not extend beyond the corresponding through port 110 and coupled port 112 (i.e., L=0) respectively. The input signal at port 118 reflects from ports 110 and 112. These reflections constructively interfere at port 120. Accordingly, the relative phase between an input signal from input port 118 and a corresponding output signal from output port 120 is 0 degrees (i.e., the input signal and the output signal are in-phase).

In FIGS. 1D and 1E, the conducting strips 114 and 116 are displaced a distance L beyond the corresponding through port 110 and coupled port 112, substantially in parallel to the respective sections of coupler 108. Conducting strips 114 and 116 thereby extend the electrical path between input port 118 and output port 120. Thus, conducting strips 114 and 116 change the reflection characteristics of through port 110 and coupled port 112 respectively (i.e., conducting strips 114 and 116 change the characteristic impedance of through port 110 and coupled port 112 respectively). The relative phase between an input signal from input port 118 and a corresponding output signal from output port 120 is between 0 and 180 degrees, depending on the displacement L. As the displacement, L, increases, the relative phase between an input signal from input port 118 and the output signal from output port 120 also increases. In other words, the relative phase between the input signal and the corresponding output signal is proportional to the distance of the displacement of conducting strips 114 and 116 (i.e., the length of L).

In FIGS. 1F and 1G, conducting strips 114 and 116 are displaced a distance of λ/4 beyond the corresponding through port 110 and coupled port 112 (i.e., L=λ/4), substantially in parallel to the corresponding sections of coupler 108. Thus, conducting strips 114 and 116 extend the electrical path between input port 114 and output port 116 by a length of λ/2. The relative phase between an input signal from input port 118 and a corresponding output signal from output port 120 is 180 degrees (i.e., the input signal and the output signal are out-of-phase). In general, when the width W of the conducting strips is constant, the phase difference between the input signal and the output signal is substantially linearly proportional to the displacement L. Furthermore, the rate of change of the relative phase (i.e., relative to the displacement of conducting strips 114 and 116) between an input signal from input port 118 and a corresponding output signal from output port 120 is related to the width W of conducting strips 114 and 116 as further described below in conjunction with FIG. 4.

Figure 2A:
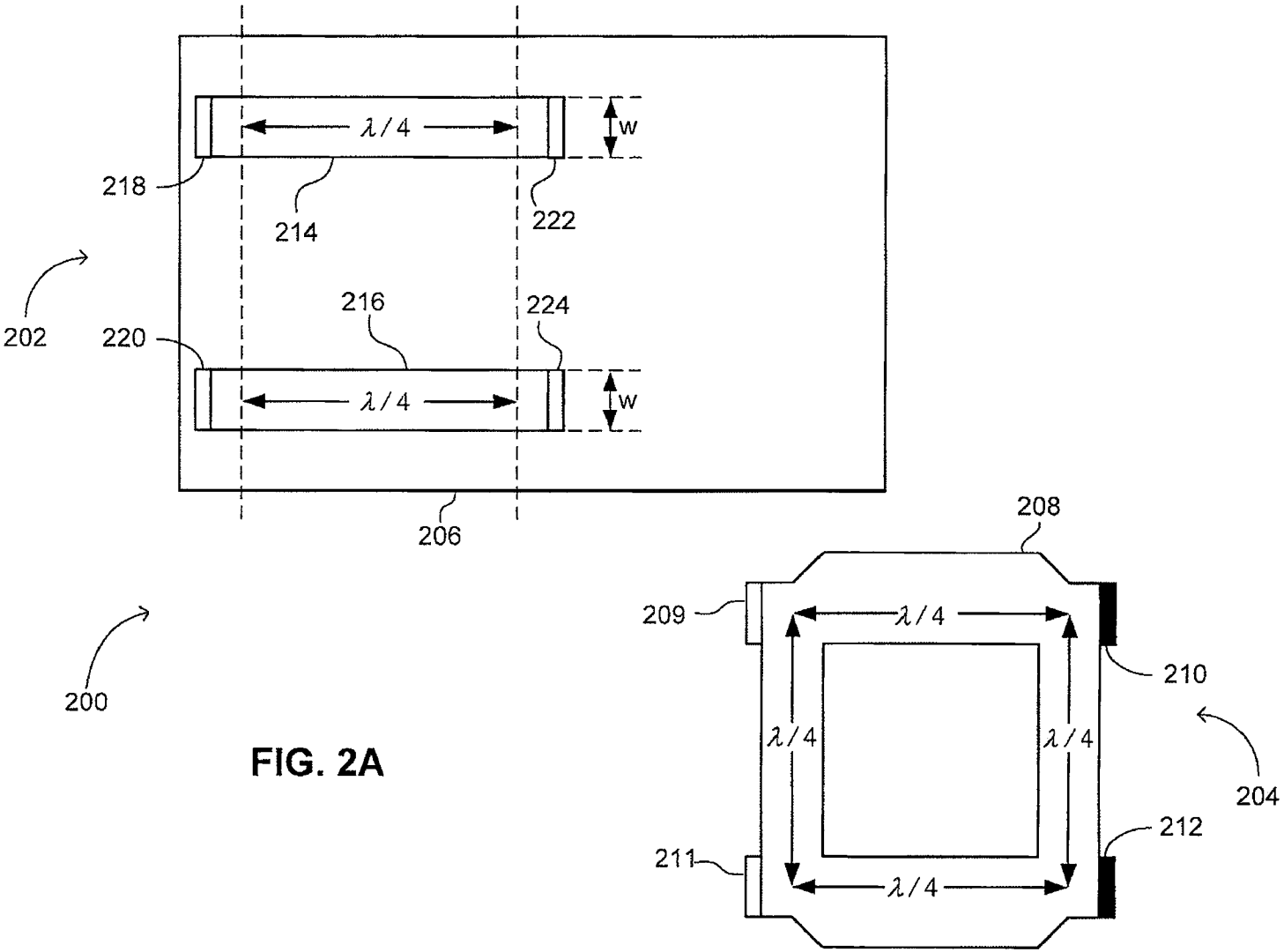
FIG. 2A is a schematic illustration of a variable phase shifter, constructed and operative in accordance with another embodiment of the disclosed invention in a disassembled state.

According to another embodiment, the movable section includes a coupler and the static section includes conducting strips. Reference is now made to FIGS. 2A-2G, which are schematic illustrations of a variable phase shifter, generally referenced 200, constructed and operative in accordance with another embodiment of the disclosed invention. FIG. 2A depicts phase shifter 200 in a disassembled state. Phase shifter 200 includes a static section 202 and a movable section 204 (as shown in FIG. 2A). Static section 202 includes a substrate 206, two conducting strips 214 (FIGS. 2A, 2B, 2D, and 2F) and 216, a signal input port 218 (FIGS. 2A, 2D, and 2F) and a signal output port 220 (FIGS. 2A, 2C and 2G). Substrate 206 is made of a dielectric material. One side of substrate 206 is coated with a layer of metal 226 (FIGS. 2C, 2E and 2G) connected to ground, thereby creating a ground plane. Substrate 206 provides mechanical support to conducting strips 214 (FIGS. 2A, 2B, 2D, and 2F) and 216. Signal input port 218 (FIGS. 2A, 2D, and 2F) is to be coupled with a signal source. The length of each of conducting strips 214 and 216 is λ/4 (FIGS. 2A and 2C) and the width of each of conducting strips 214 and 216 is W (FIG. 2A). Conducting strips 214 and 216 are both terminated with an open circuit designated 222 (FIGS. 2A, 2D, and 2F) and 224 (FIGS. 2A, 2C, 2D, 2F, and 2G). Movable section 204 includes a coupler 208. Coupler 208 includes an input port 209 (FIGS. 2A, 2B, 2D, and 2F), a through port 210 (FIGS. 2A, 2B, 2D, and 2F), an output port 211 (FIGS. 2A, 2B, 2D, and 2F) and a coupled port 212. Input port 209 and output port 211 are both open circuit. Similar to as mentioned above, input port 209 is a signal inlet and output port 211 is a signal outlet. In some coupler configurations, the roles of input port 209 and output port 211 may be reversed. Through port 210 and coupled port 212 are either open circuit or closed circuit. Similarly to coupler 108 (FIGS. 1A-1G), coupler 208 is embodied as a quadrature hybrid coupler. The length of each of the sides of coupler 208 as shown in FIG. 2A is λ/4.

Coupler 208 may be, for example, a micro-strip coupler, a strip-line coupler or a co-planar waveguide coupler. Conducting strip 214 is coupled with substrate 206 on the side opposite to metal layer 226 and with signal input port 218. Conducting strip 216 is coupled with substrate 206 also on the side opposite to metal layer 226 and with signal input port 220 (FIG. 2C).

Figure 2B:
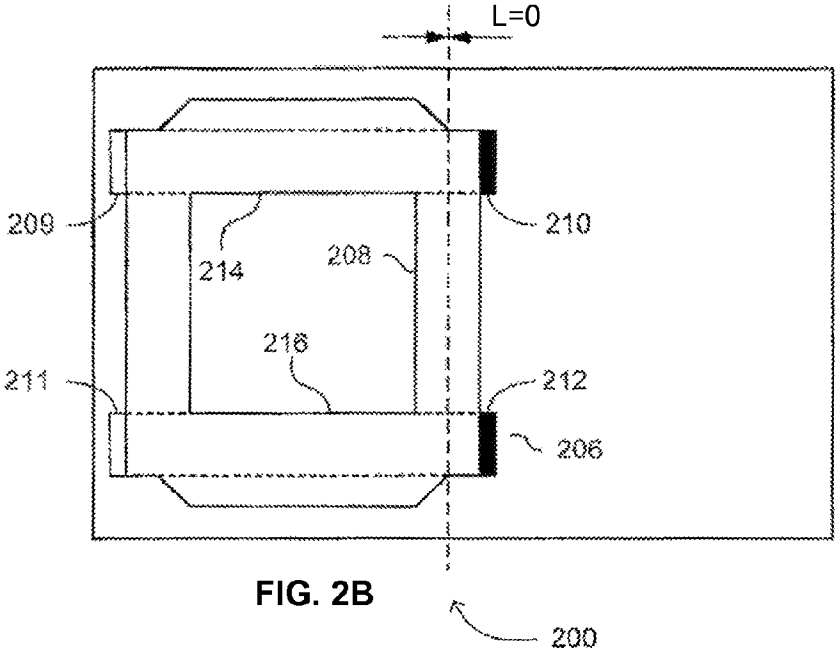
FIGS. 2B, 2D and 2F are schematic illustration of top views of the phase shifter of FIG. 2A at different states of operation.
Figure 2C:
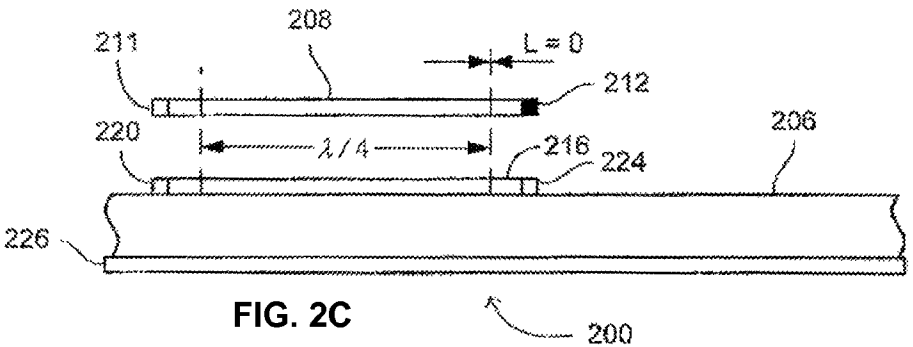
FIGS. 2C, 2E and 2G are schematic illustration of side views of the phase shifter of FIG. 2A at different states of operation.
Figure 2D:
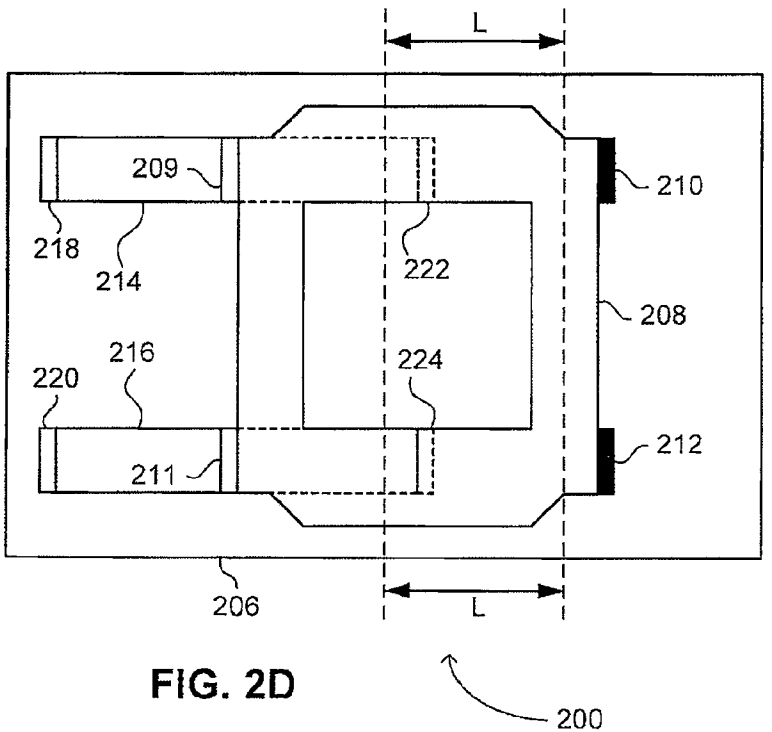
Figure 2E:
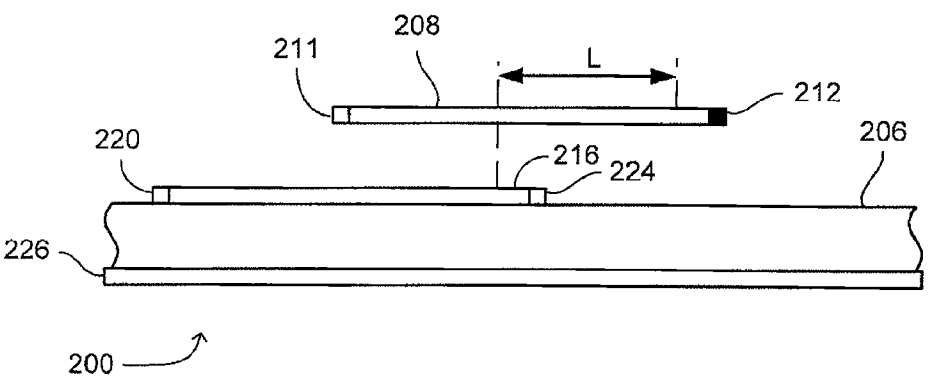
Figure 2G:
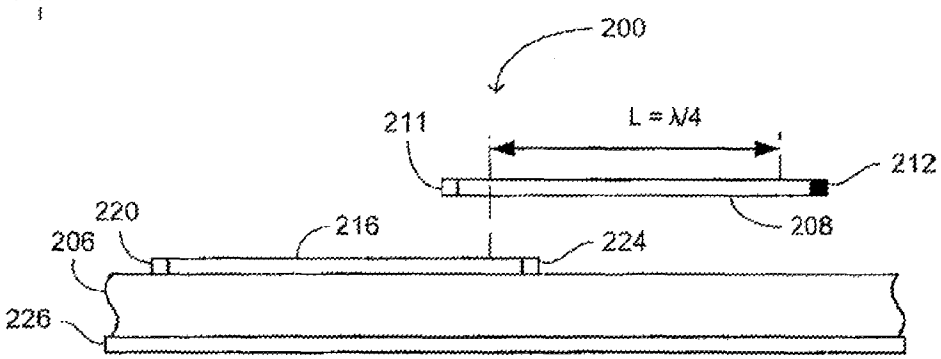
Figure 2F:
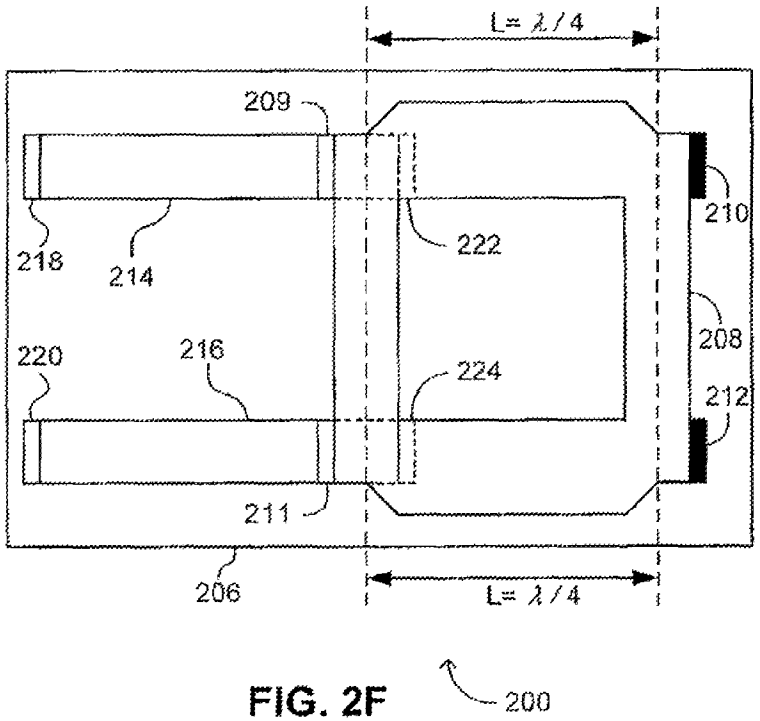

FIGS. 2B-2G depict phase shifter 200 in an assembled state at different states of operation. FIGS. 2B, 2D and 2F depict top views of phase shifter 100 and FIGS. 2C, 2E and 2G depict a side view of system 200 at different states of operation as further explained below. In FIGS. 2B-2G, conducting strip 214 is movably coupled with the section of coupler 208, which connects input port 209 with through port 210. Conducting strip 216 is movably coupled with the opposite section of coupler 208 (i.e., the section of coupler 208, which connects output port 211 with coupled port 212). Furthermore, coupler 208 is coupled to a movable mechanical support made of dielectric material (not shown). In FIGS. 2B and 2C, coupler 208 is in an initial position. In this initial position, conducting strips 214 and 216 overlap with the respective opposite sections of coupler 208. Coupler 208 does not extend beyond conducting strips 214 and 216 (i.e., L=0). The input signal at port 218 reflects from through port 210 and coupled port 212. These reflections constructively interfere at output port 220. Accordingly, the relative phase between an input signal from input port 218 and a corresponding output signal from output port 220 is 0 degrees.

In FIGS. 2D and 2E, coupler 208 is displaced a distance L beyond conducting strips 214 and 216, substantially in parallel with conducting strips 214 and 216. Thus, coupler 208 extends the electrical path between input port 218 and output port 220. The relative phase between an input signal from input port 218 and a corresponding output signal from output port 220 is between 0 and 180 degrees. As L increases, the relative phase between an input signal from input port 218 and the output signal from output port 220 also increases. In other words, the relative phase between the input signal and the corresponding output signal is proportional to the distance of the displacement of coupler 208.

In FIGS. 2F and 2G, coupler 208 is displaced a distance of λ/4 beyond conducting strips 214 and 216 (i.e., L=λ/4), substantially in parallel with conducting strips 214 and 216. The relative phase between an input signal from input port 218 and the output signal from output port 220 is 180 degrees. Thus, by displacing coupler 208, conducting strips 214 and 216 extend the electrical path between input port 218 and output port 220 by a length of λ/2. The relative phase between an input signal from input port 218 and a corresponding output signal from output port 220 is thus 180 degrees. As mentioned above, when the width W of the conducting strips is constant, the phase difference between the input signal and the output signal is substantially linearly proportional to L, with the rate of change of the relative phase between an input signal from input port 218 and a corresponding output signal from output port 220 being related to the width W of conducting strips 214 and 216.

Figure 3A:
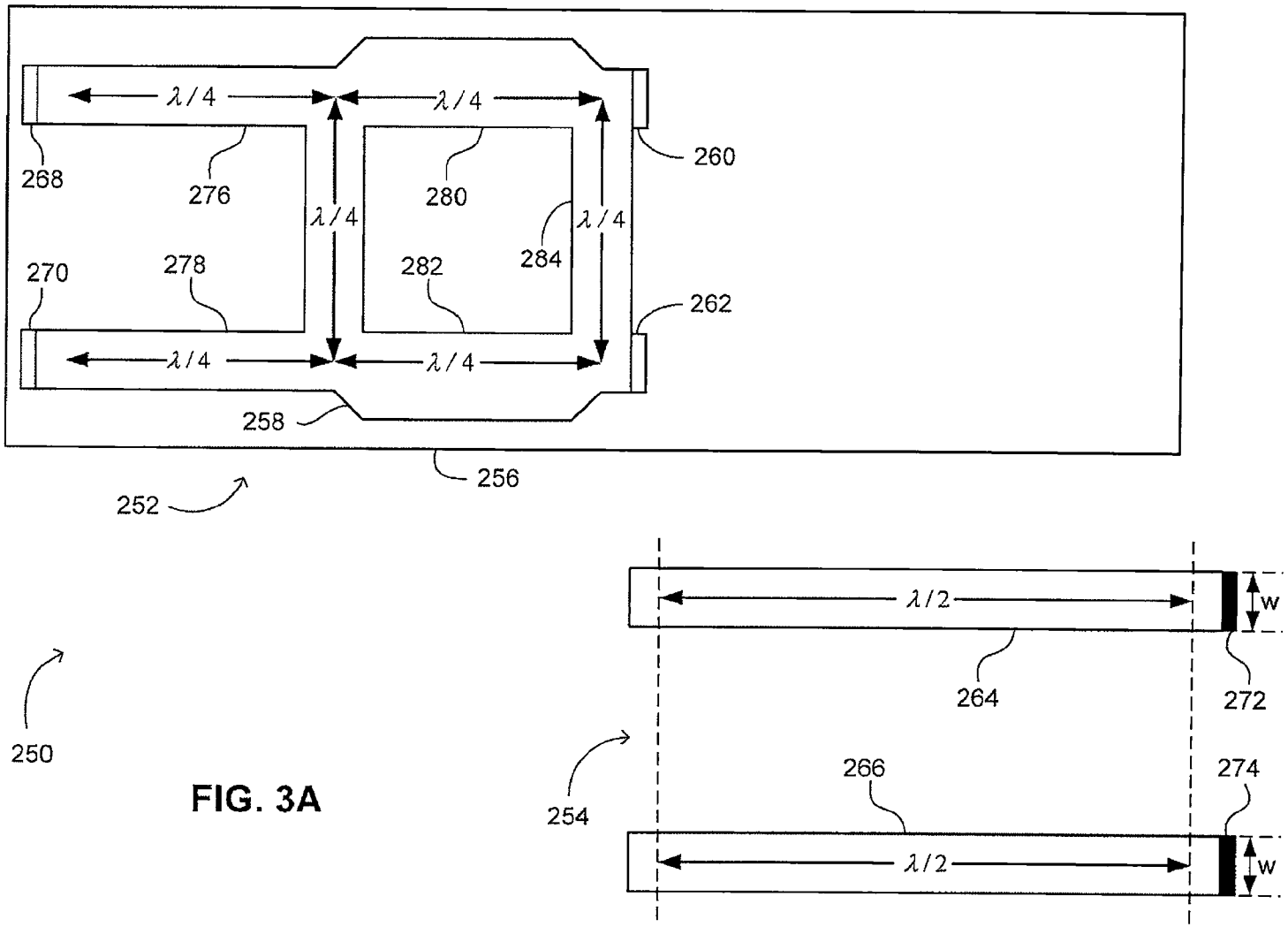
FIG. 3A is a schematic illustration of a variable phase shifter, constructed and operative in accordance with a further embodiment of the disclosed invention in a disassembled state.
Figure 3B:
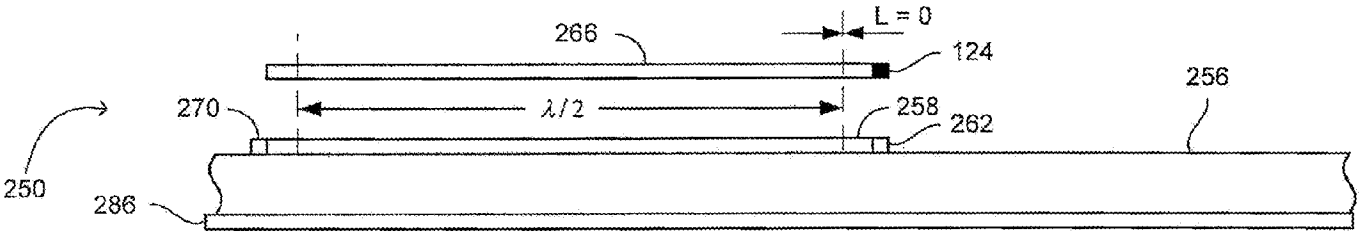
FIG. 3B is schematic illustration of a side view of the phase shifter of FIG. 3A at an assembled state.
Figure 3D:
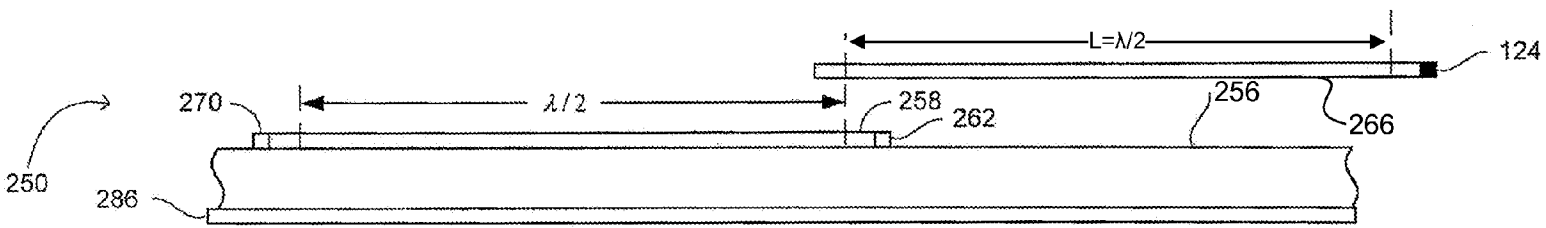
FIG. 3D is a schematic illustration of a side view of the phase shifter of FIG. 3A at another assembled state.
Figure 3C:
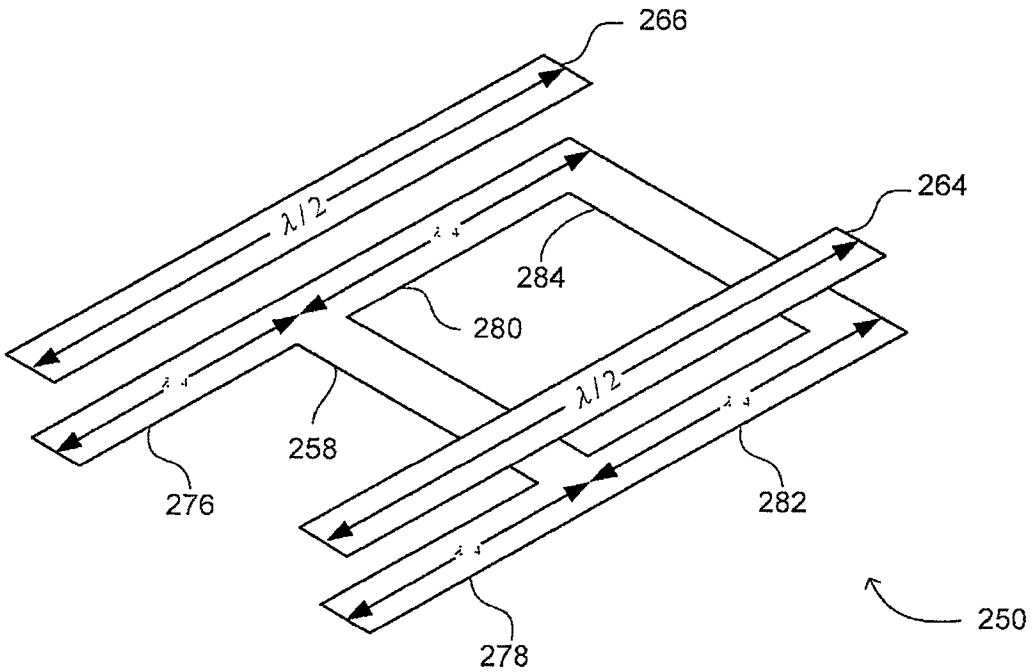
FIG. 3C is schematic illustration of a simplified isometric view of the phase shifter of FIG. 3A.

In FIGS. 1A-1G and 2A-2G, the length of the conducting strips is λ/4 (i.e., since the required phase shift range is 180 degrees). However, when the required phase shift range is larger than 180 degrees, the length of the conducting strips is larger than λ/4. Accordingly, the coupler includes extensions coupling the input port and the output port with the coupler, such that at a phase shift of 0 degrees, the conducting strips completely overlap with the corresponding section of the coupler (i.e., including the extensions). Reference is now made to FIGS. 3A, 3B and 3C, which are schematic illustrations of a variable phase shifter, generally referenced 250, constructed and operative in accordance with a further embodiment of the disclosed invention. FIG. 3A depicts phase shifter 250 in a disassembled state. FIG. 3B depicts a side view of phase shifter 250 at an assembled state. FIG. 3C depicts a simplified isometric view of phase shifter 250.

Phase shifter 250 includes a static section 252 and a movable section 254 (as shown in FIG. 3A). Static section 252 includes a substrate 256 (FIGS. 3A, 3B, 3D), and a coupler 258. Substrate 256 is made of a dielectric material. One side of substrate 256 is coated with a layer of metal 286 (FIG. 3B, 3D) connected to ground, thereby creating a ground plane Coupler 258 includes a through port 260, a coupled port 262, an input port 268 (see FIG. 3A for these ports), an output port 270 (FIGS. 3A, 3B, 3D) a first extensions 276 and a second extension 278 (see FIGS. 3A, 3C for the extensions). The lengths of both first and second extensions 276 and 278, as shown in FIGS. 3A and 3C, is λ/4. Input port 268 is a signal inlet, which is to be coupled with signal source. Output port 270 is signal outlet. In some coupler configurations, the roles of input port 268 and output port 270 may be reversed. Through port 260 and coupled port 262 are both open circuited. In FIGS. 3A and 3B, coupler 258 is embodied as a quadrature hybrid coupler. Coupler 258 may be, for example, a micro-strip coupler, a strip-line coupler or a co-planar waveguide coupler. Accordingly, the length of each side of coupler 258 is λ/4 (as shown in FIGS. 3A and 3C). Coupler 258 is coupled with substrate 256 on the side opposite to metal layer 286 (shown in FIG. 3B). First extension 276 extends from coupler section 280 (FIGS. 3A, 3C) of coupler 258 in the direction of input port 268 and parallel to section 280. One end of first extension 276 is connected to coupler section 280 and input port 268 is located at the other end of first extension 276. Coupler section 280 is perpendicular to coupler section 284 (FIGS. 3A, 3C) connecting through port 260 and coupled port 262 from through port side of coupler section 284. Second extension 278 extends from coupler section 282 (FIGS. 3A, 3C) of coupler 258 in the direction of output port 110 and parallel to section 282. One end of second extension 278 is connected to coupler section 282 and output port 270 is located at the other end of first extension 278. Coupler section 282 is perpendicular to coupler section 284 connecting through port 260 and coupled port 262 from coupled port side of coupler section 284.

Movable section 254 includes two conducting strips 264 (FIGS. 3A, 3C) and 266. As mentioned above, the length of conducting strips 264 and 266 is related to the required phase shift range. In FIGS. 3A and 3B and 3C and 3D, each one of conducting strip 264 and 266 is of length λ/2 (FIG. 3A, 3C) and width W (FIG. 3A) resulting in a phase shift range of 360 degrees. Conducting strip 264 and 266 are both terminated with either an open circuit or a short circuit 272 and 274 respectively. Thus, through port 260 and coupled port 262 are terminated by equal reflective elements created by conducting strips 264 and 266 respectively.

In FIG. 3B, conducting strips 264 and 266 are in an initial position. Conducting strip 264 is movably coupled with the section of coupler 258, which connects input port 268 with through port 260, and conducting strip 266 is movably coupled with the section of coupler 258, which connects output port 270 with coupled port 262. Furthermore, conducting strips 264 and 266 are coupled to a movable mechanical support made of dielectric material (not shown). In this initial position conducting strips 264 and 266 overlap with the respective opposite section of coupler 258 and with the respective extensions 276 and 278 thereof and do not extend beyond the corresponding through port 260 and coupled port 262 (i.e., L=0). Accordingly, the relative phase between an input signal from input port 268 and a corresponding output signal from output port 270 is 0 degrees (i.e., the input signal and the output signal are in-phase). Similarly, as described above in conjunction with FIGS. 1A-1G and 2A-2G, the relative phase between an input signal from input port 268 and a corresponding output signal from output port 270 increases linearly as conducting strips 264 and 266 are displaced over through port 260 and coupled port 262 respectively. In FIGS. 3A and 3B, the length of the conducting strips is λ/2. Thus, in FIG. 3D when conducting strips 264 and 266 are fully displaced (i.e., L=λ/2), conducting strips 264 and 266 extend the electrical path between input port 268 and output port 270 by λ and the phase shift range is 360 degrees. As mentioned above, in general, the phase shift range is related to the length of the conducting strips. Thus, the length of the conducting strips is determined according to the required phase shift range. Similar to as described herein above in conjunction with FIGS. 2A-2G, the static section may include conducting strips 264 and 266 and the movable section may include coupler 258.

In general, the conducting strips may be of any length. However, it is noted that, when the required phase shift range is larger than 180 degrees, the combined length of the section of the coupler connecting the through port with the input port (i.e., including the corresponding extension) should at least equal the length of the conducting strip. Similarly, the combined length of the section of the coupler connecting the coupled port with the output port (i.e., including the corresponding extension) should also at least equal the length of the conducting strip.

Figure 4:
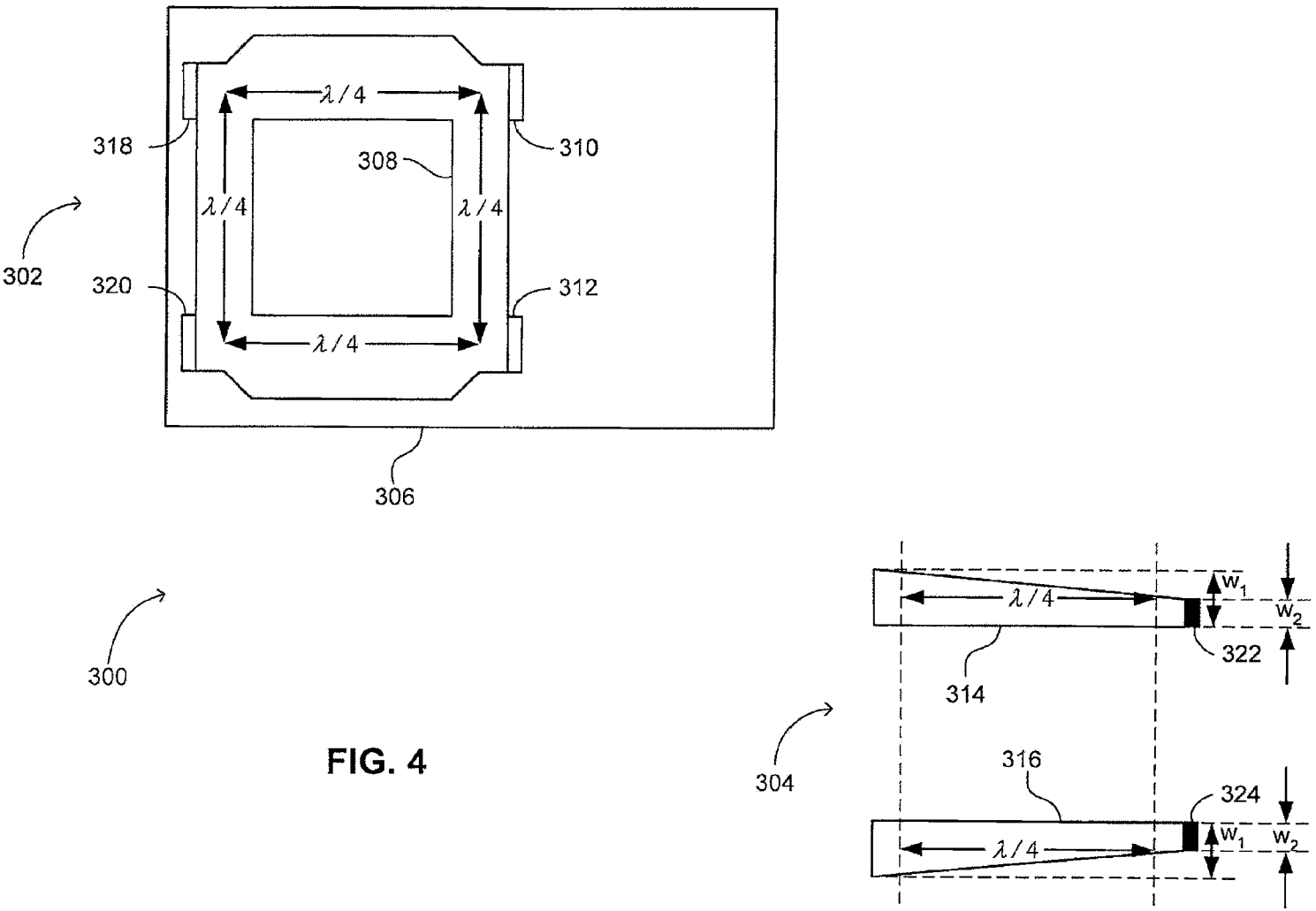
FIG. 4 is a schematic illustration of a variable phase shifter, constructed and operative in accordance with another embodiment of the disclosed invention in a disassembled state.

As described above, when the width of the conducting strips is constant, the phase of the output signal, relative to the input signal, varies linearly with the displacement of the conducting strips. According to another embodiment, the width of the conducting strips varies along "the length 'thereof, thereby changing the rate of change of the relative phase between the input signal and the output signal, relative to the displacement of the conducting strips. An example of the different types of changes in the width of the conducting strips in which the width varies according to at least one of the ends includes: linearly; exponentially; polynomially; and piecewise linearly. Reference is now made to FIG. 4, which is a schematic illustration of a variable phase shifter, generally referenced 300, constructed and operative in accordance with another embodiment of the disclosed invention. FIG. 4 depicts phase shifter 300 in a disassembled state. Phase shifter 300 includes a static section 302 and a movable section 304. Static section 302 includes a substrate 306, a coupler 308. Coupler 308 includes an input port 318 an output port 320, a through port 310 and a coupled port 312. Input port 318 is a signal inlet, which is to be coupled with signal source. Output port 320 is signal outlet. In some coupler configurations, the roles of input port 318 and output port 320 may be reversed. Coupler 308 is embodied as a quadrature hybrid coupler. Accordingly, the length of each side of coupler 308 is $\lambda/4$. Coupler 308 may be, for example, a micro-strip coupler, a strip-line coupler or a co-planar waveguide coupler. Through port 310 and coupled port 312 are open circuit ports. Coupler 308 is coupled with substrate 306. Movable section 304 includes two conducting strips 314 and 316 each of length $\lambda/4$. The width of each of conducting strips 314 and 316 reduces from a width $W_1$ at one end of the conducting strip to a width $W_2$ at the other end of the conducting strip. Conducting strips 314 and 316 are both terminate with either an open circuit or a short circuit designated by 322 and 324. In FIG. 4, the width of conducting strips 314 and 316 varies substantially linearly along the length thereof. Thus, the phase of the output signal, relative to the input signal, may vary, for example, polynomially with the displacement of the conducting strips. However, it is noted that the actual variation of the phase output signal, relative to the input signal depends on a plurality of factors such as the separation distance between the conducting strips and the coupler, the thickness of the conducting strips, the materials from which the conducting strips and the coupler are made of and the like. However, the width of the conducting strips may vary according to various shapes, patterns or mathematical functions (e.g., exponentially, polynomially, piecewise linearly, saw tooth, randomly and the like). The rate of change of the relative phase between the input signal and the output signal will thereby vary accordingly. In the assembled state (not shown) strip 314 is movable coupled with through port 310. Conducting strip 316 is movably coupled with coupled port 312. In an initial position, conducting strips 314 and 316 coincide with the respective opposite sides of coupler 308, and do not extend beyond the corresponding through ports 310 and coupled port 312 thereof. Similarly to the phase shifters described hereinabove in conjunction with FIGS. 1A-1G 2A-2G and 3A-3C conducting strips 314 and 316 are displaced over through and coupled ports 310 and 312 (i.e., substantially in parallel to the corresponding sections of coupler 308). The relative phase between an input signal at input port 318 and a corresponding output signal from output port 320, changes relative to the displacement of the of the conducting strips. Furthermore, the rate of change of the relative phase between an input signal at input port 318 and an output signal from output port 320 changes relative to the displacement of the conducting strips 314 and 316.

In the description above of FIGS. 1A-1G, 2A-2G, 3A-3C and 4, either the conducting strips are displace or the coupler is displaced. It is noted that, in general, the conducting strips and the coupler are displaced relative to each other (i.e., either the conducting strips are displaced, or the coupler is displaced or both are displaced).

Figure 5:
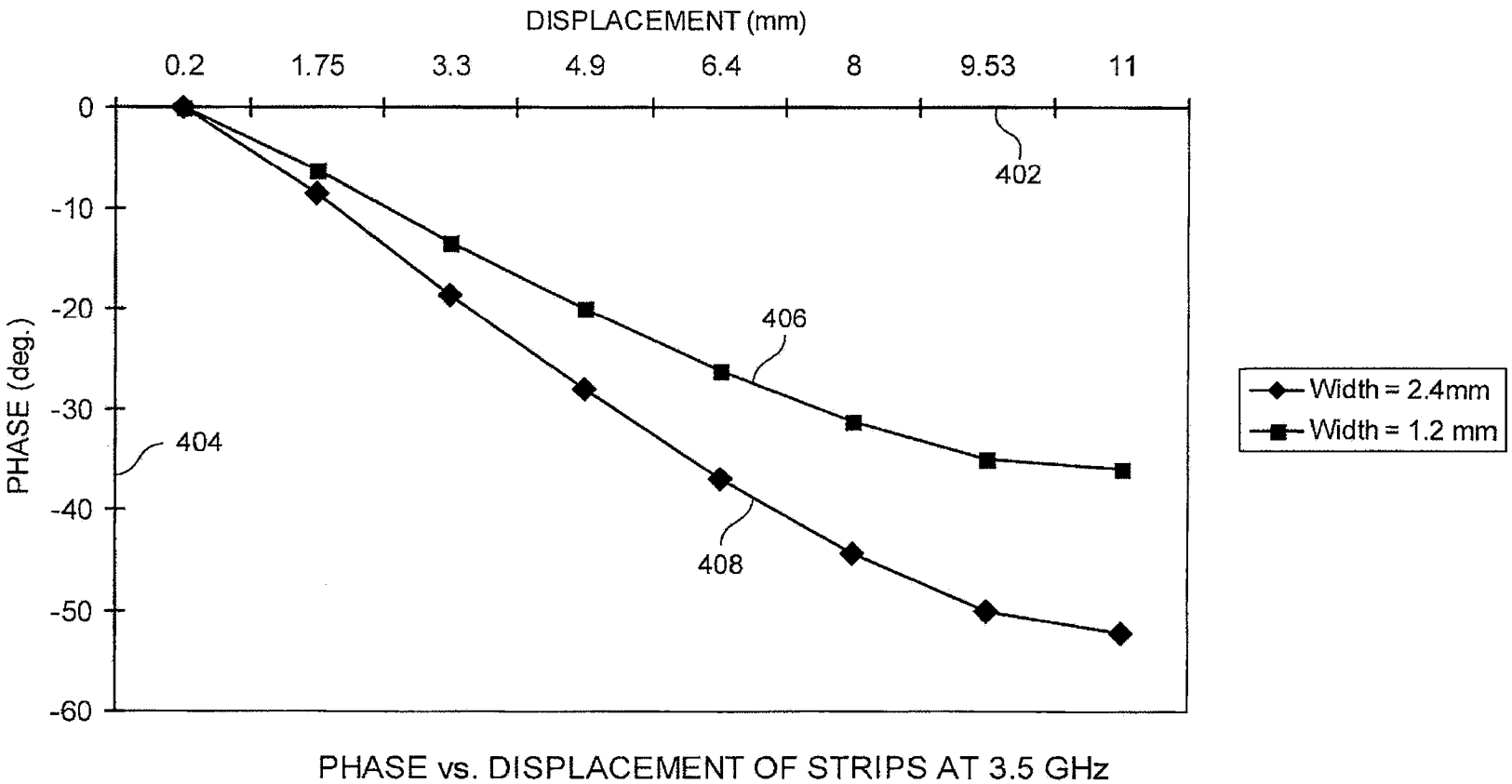
FIG. 5 is a schematic illustration of a graph in accordance with a further embodiment of the disclosed invention.

Reference is now made to FIG. 5, which is a schematic illustration of a graph, generally referenced 400, in accordance with a further embodiment of the disclosed invention. Graph 400 includes a horizontal axis 402, a vertical axis 404 and two curves 406 and 408. Horizontal axis 402 refers to the distance of the displacement in millimeters (abbreviated 'mm' in FIG. 5) of the movable sections of the phase shifters depicted above in FIGS. 1A-1G, 2A-2G, 3A-3C and 4. Vertical axis 404 refers to the phase difference in degrees (abbreviated 'deg.' In FIG. 5) between the output port and the input ports of the phase shifters depicted above in FIGS. 1A-1G, 2A-2G, 3A-3C and 4. Curves 406 and 408 depicts the phase difference between an input signal and an output signal of a respective phase shifter (not shown), as a function of the different distances of displacement of the movable section of the respective phase shifters thereof, at a center frequency of 3.5 gigahertz (abbreviated GHz in FIG. 5). The phase shifter respective of curves 406 and 408 are according to any of the embodiments depicted hereinabove in conjunction with FIGS. 1A-1G, 2A-2G, 3A-3C and 4. The phase shifter respective of curve 406 includes conducting strips having a width of 1.2 millimeters. The phase shifter respective of curve 408 includes conducting strips having a width of 2.4 millimeters. The data according to which graph 400 was drawn is listed in Table 1 below.

TABLE 1

Phase Difference Between The Input Signal And Output Signal At Two Different Width Of The Conducting Strips

| Distance of displacement (mm) | Phase difference between the input signal and output signal (W = 1.2 mm) | Phase difference between the input signal and output signal (W = 2.4 mm) |
|---|---|---|
| 0.2 | 0° | 0° |
| 1.75 | −6.3° | −8.5° |
| 3.3 | −13.4° | −18.6° |
| 4.9 | −20° | −28° |
| 6.4 | −26.2° | −37° |
| 8 | −31.3° | −44.4° |
| 9.53 | −35° | −50° |
| 11 | −36° | −52.3° |

It is noted that the lengths and shapes of the conducting strips and couplers described hereinabove in conjunction with FIGS. 1A-1G, 2A-2G, 3A-3C and 4 refer to the electric lengths and shapes of the conducting strips and couplers (i.e., in terms of the wavelengths of the signals propagating through these conducting strips and couplers). The physical lengths and shapes of the conducting strips and the coupler may be different. Furthermore, the conducting strips and couplers described hereinabove in conjunction with FIGS. 1C, 1E, 1G, 2C, 2E, 2G and 3B where depicted as capacitively coupled with each other. However, the conducting strips may be electrically coupled with each other (i.e., forming an electrical contact there between). Additionally, when the conducting strips and the coupler are capacitively coupled, the rate of change of the relative phase between an input signal and a corresponding output signal is also affected by the distance between the conducting strips and the coupler. It is further noted that the phase shifters described hereinabove in conjunction with FIGS. 1A-1G, 2A-2G, 3A-3C and 4 employ no active elements (e.g., transistors or diodes). Thus, Passive Intermodulation (i.e., PIM—the mixing of two or more signals of different frequencies, forming additional signals at frequencies that are not at harmonic frequencies of either of the initial frequencies) is substantially reduced.

Figure 6:
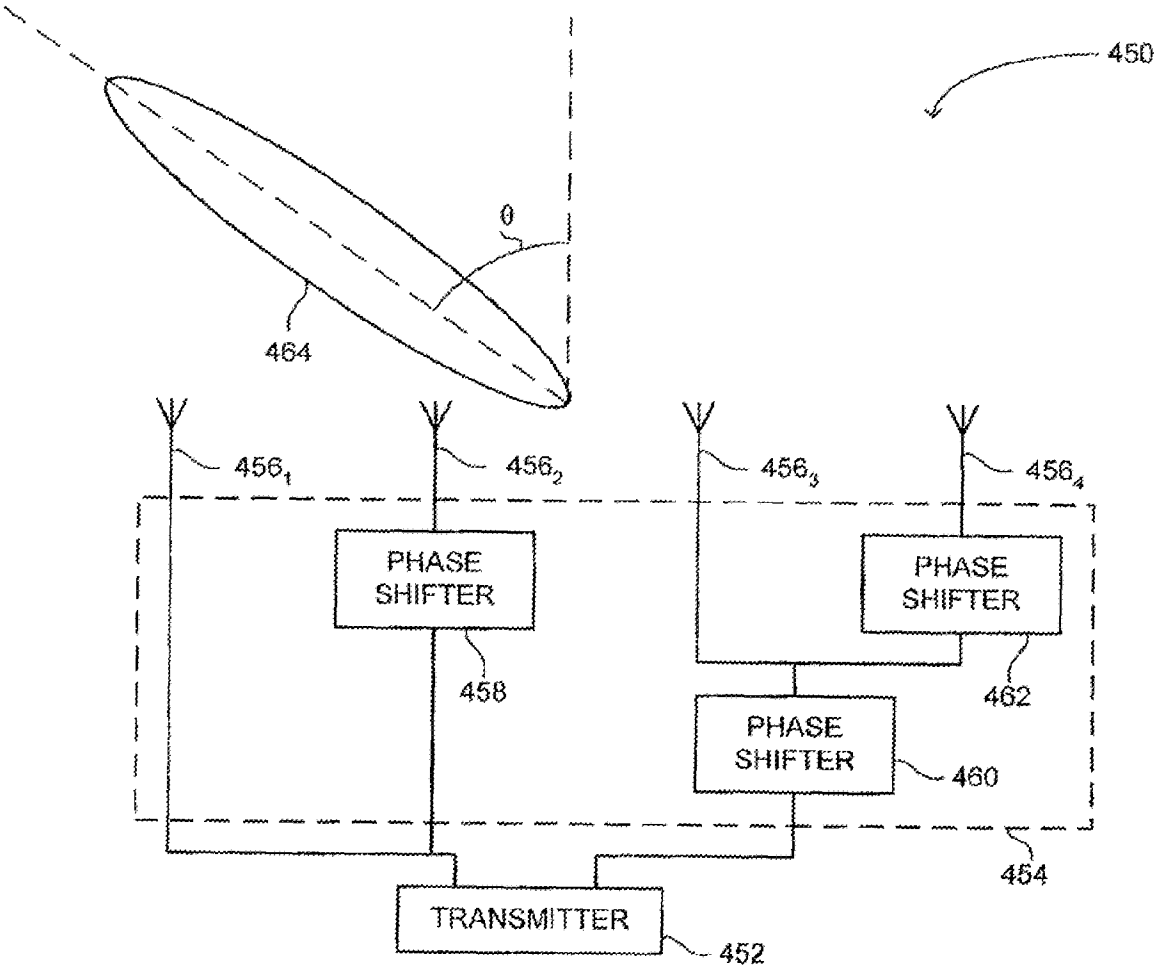
FIG. 6 is a schematic illustration of antenna array system, constructed and operative in accordance with another embodiment of the disclosed invention.

The phase shifter may be employed in an array of phase shifters providing, for example, phase shifted versions of a signal to antennas in an antenna array (i.e., a feeding network or a signal distribution network). In antenna arrays, each antenna is provided with a signal exhibiting a phase shift relative to the other antennas. Reference is now made to FIG. 6, which is a schematic illustration of antenna array system, generally referenced 450, constructed and operative in accordance with another embodiment of the disclosed invention. System 450 includes a transmitter 452, a signal distribution network 454, and antennas $\mathbf{456}_1$, $\mathbf{456}_2$, $\mathbf{456}_3$ and $\mathbf{456}_4$. Signal distribution network 454 includes an array of phase shifters 458, 460 and 462. Antennas $\mathbf{456}_1$, $\mathbf{456}_2$, $\mathbf{456}_3$ and $\mathbf{456}_4$ form, for example, an antenna array for transmitting a beam 464 of electromagnetic waves, substantially at an angle from system 450. This angle is related to the difference between the phases of the signal provided to each of the antennas.

Transmitter 452 is coupled with antenna $\mathbf{456}_1$, with phase shifter 458 and with phase shifter 460. Phase shifter 460 is coupled with antenna $\mathbf{456}_3$. Phase shifter 458 is coupled with antenna $\mathbf{456}_2$ and phase shifter 462. Phase shifter 462 is coupled with antenna $\mathbf{456}_4$. Phase shifters 458, 460 and 462 form a two level parallel signal distribution network of a signal to antennas $\mathbf{456}_1$, $\mathbf{456}_2$, $\mathbf{456}_3$ and $\mathbf{456}_4$. Phase shifter 458 forms the first level of phase shifters and phase shifters 460 and 462 form the second level of phase shifters. In the parallel signal distribution network of FIG. 6, the phase shift associated with the phase shifters in each level is half the phase shift associated with the phase shifters in the previous level. Thus, the phase shift associated with phase shifters 460 and 462 is half the phase shift associated with phase shifter 458.

Transmitter 452 provides a transmitted signal to antenna $\mathbf{456}_1$, to phase shifter 460 and to phase shifter 458. Phase shifter 458 shifts the phase of the transmitted signal by a phase shift associated therewith (i.e., the required phases shift between antenna $\mathbf{456}_1$ and $\mathbf{456}_2$) phase shifted signal to antennas $\mathbf{456}_2$. Phase shifter 460 shifts the phase of the transmitted signal by a phase shift associated therewith, and provides the phase shifted transmitted signal to antenna $\mathbf{456}_3$ and to phase shifter 462.

Phase shifter 462 shifts the phase of the transmitted signal by a phase shift associated therewith (i.e., the required phases shift between antenna $\mathbf{456}_3$ and $\mathbf{456}_4$), and provides the phase shifted transmitted signal to antenna $\mathbf{456}_4$.

As mentioned above, the phase shift associated with phase shifters 460 and 462 is half the phase shift associated with phase shifter 458. Accordingly, every degree of change in the phase shift associated with phase shifters 460 and 462 requires a two degrees change in the phase shift associated with phase shifter 458. Thus, when employing a variable phase shifter described herein above in conjunction with FIGS. 1A-1G, 2A-2G, 3A-3C and 4, the conducting strips are displaced by distance having a proportionality factor relative each other corresponding to required phase shift. For example, the conducting strips (not shown) of phase shifter 458 are displaced double the distance of the displacement of the conducting strips (not shown) of phase shifter 460 and 462. Alternatively, the conducting strips of phase shifter 458 may be wider than the conducting strips of phase shifters 460 and 462 such that for the same displacement, the change in phase shift associated with phase shifter 458 will be double the change in the phase shift associated with phase shifters 460 and 462. In other words, phase shifter 458 exhibits a different unit phase shift for each unit of displacement than phase shifters 460 and 462. Thus, the phase shift associated with phase shifters 458, 460 and 462 may be commonly controlled by displacing the respective movable sections thereof by the same distance.

Figure 7:
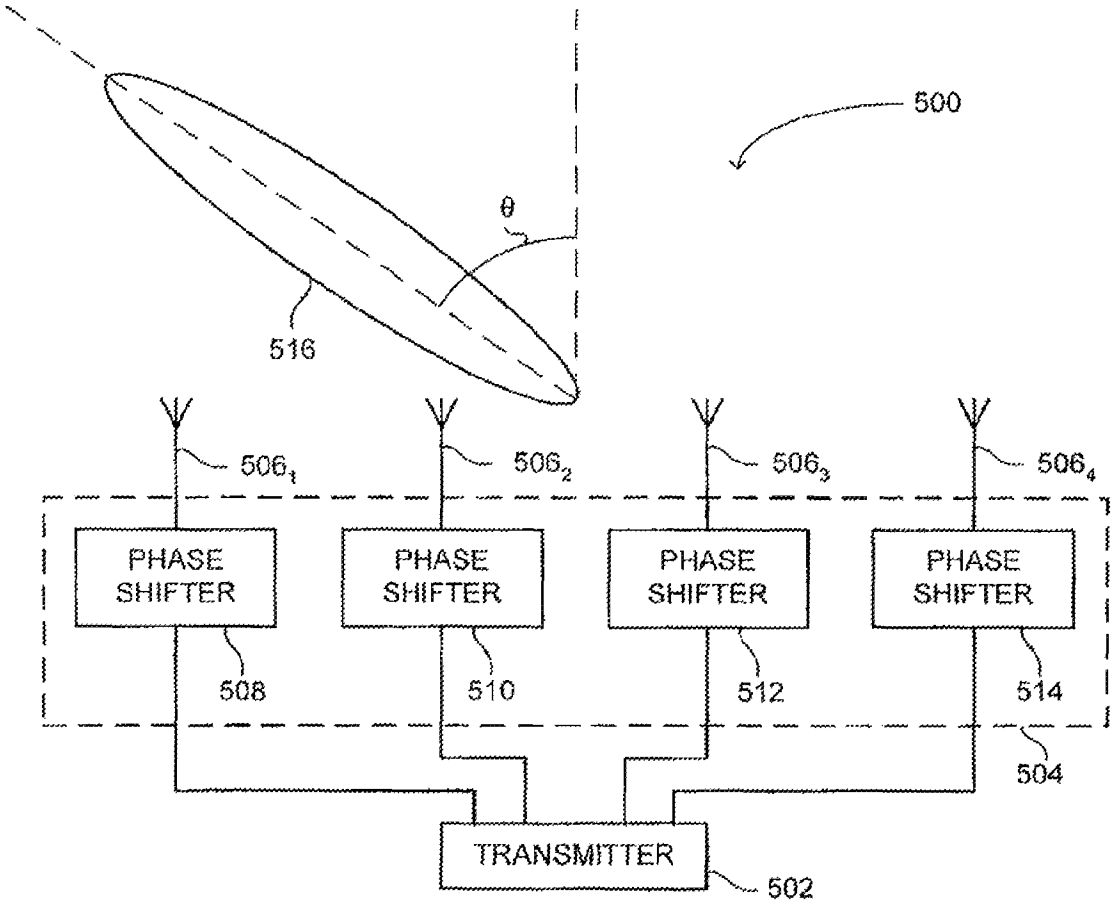
FIG. 7 is a schematic illustration of antenna array system, constructed and operative in accordance with a further embodiment of the disclosed invention.

Reference is now made to FIG. 7, which is a schematic illustration of antenna array system, generally referenced 500, constructed and operative in accordance with a further embodiment of the disclosed invention. System 500 includes a transmitter 502, a signal distribution network 504, and antennas $\mathbf{506}_1$, $\mathbf{506}_2$, $\mathbf{506}_3$ and $\mathbf{506}_4$. Signal distribution network 504 includes an array of phase shifters 508, 510, 512 and 514. Antennas $\mathbf{506}_1$, $\mathbf{506}_2$, $\mathbf{506}_3$ and $\mathbf{506}_4$ form, for example, an antenna array for transmitting a beam 516 of electromagnetic waves, substantially at an angle from system 500. As mentioned above, this angle is related to the difference between the phases of the signal provided to each of the antennas.

Transmitter 502 is coupled with phase shifters each one of phase shifters 508, 510, 512 and 514. Each one of phase shifters 508, 510, 512 and 514 is coupled with a corresponding antenna. Phase shifter 508 is coupled with antenna $\mathbf{506}_1$. Phase shifter 510 is coupled with antenna $\mathbf{506}_2$, phase shifter 512 is coupled with antenna $\mathbf{506}_3$ and phase shifter 514 is coupled with antenna $\mathbf{506}_4$. Phase shifters 508, 510, 512 and 514 form a single level parallel signal distribution network of a signal to antennas $\mathbf{506}_1$, $\mathbf{506}_2$, $\mathbf{506}_3$ and $\mathbf{506}_4$.

Transmitter 502 provides a transmitted signal to each one of phase shifters 508, 510, 512 and 514. Each one of phase shifters 508, 510, 512 and 514 shifts the phase of the transmitted signal by a phase shift associated therewith. The phase shift associated with each of phase shifter 508, 510, 512 and 514 is related to the angle and to the relative position between the antennas corresponding thereto. For example, at a center frequency of 1 GHz, the wavelength is 0.3 meters. When the relative distance between adjacent antennas is $\lambda/2$ (i.e., 0.15 meters) and the required transmission or reception angle is 30 degrees (i.e., 9=30°), the relative phase between adjacent antennas is 90 degrees. Accordingly, phase shifter 508 shifts the phase of the transmitted signal by 0 degrees, phase shifter 510 shifts the phase of the transmitted signal by 90 degrees, phase shifter 510 shifts the phase of the transmitted signal by 180 degrees and phase shifter 514 shifts the phase of the transmitted signal by 270 degrees. As mentioned above in conjunction with FIG. 6, when employing a variable phase shifter, as described in conjunction with FIGS. 1A-1G, 2A-2G, 3A-3C and 4, the conducting strips are displaced by distance having a proportionality factor relative each other corresponding to required phase shift. Thus, according to the above example, phase shifter 512 is displaced double the distance of the displacement of phase shifter 510. Proportional displacement may be achieved, for example, by known in the art lever based mechanisms, pulley based mechanisms and the like. Alternatively, the width of the conducing strips of each of phase shifter 508, 510, 512 and 514 is different, and corresponds to the required relative rate of change of the phase shift. Thus, each of phase shifter 508, 510, 512 and 514 is displaced by the same distance but changes the phase of the transmitted signal by the respective phase shift associated therewith. Thus, phase shifter 508, 510, 512 and 514 may be commonly controlled by displacing the respective movable sections thereof by the same distance (i.e., In other words, each phase shifter exhibits a different unit phase shift for each unit of displacement).

It will be appreciated by persons skilled in the art that the disclosed invention is not limited to what has been particularly shown and described hereinabove. Rather the scope of the disclosed invention is defined only by the claims, which follow.

The invention claimed is:

1. A variable phase shifter having a center frequency comprising:

a branch line coupler including an input port, an output port, a through port and a coupled port; and two conducting finite strips exhibiting equal lengths, a first one of the two conducting strips being movably coupled with a first section of said coupler, said first section connecting said input port with said through port and a second one of the two conducting strips and the second conducting strip being movably coupled with a second section of said coupler, said second section connecting said output port and with said coupled port, wherein displacing said conducting strips relative to said coupler, changes the phase of an output signal from said coupler, relative to the phase of a corresponding input signal into said coupler.

2. The variable phase shifter according to claim 1, wherein said first and second conducting strips are static and said coupler moves relative to said conducting strips.

3. The variable phase shifter according to claim 1, wherein said branch line coupler is a quadrature hybrid coupler.

4. The variable phase shifter according to claim 1, wherein said first conducting strip moves substantially in parallel to said corresponding first coupler section connecting said input port with said through port, and wherein, said second conducting strip moves substantially in parallel to said corresponding second coupler section connecting said output port with said coupled port.

5. The variable phase shifter according to claim 4, wherein the length of each of said first and second conducting strips does not exceed a quarter of the wavelength corresponding to the center frequency of said variable phase shifter.

6. The variable phase shifter according to claim 1, wherein said coupler includes a first extension connecting said input port with said coupler and a second extension connecting said output port with said coupler, and wherein said first extension extends from said first coupler section in the direction of said input port and parallel to said first corresponding coupler section, said second extension extends from said second coupler section in the direction of said output port and parallel to said second corresponding section.

7. The variable phase shifter according to claim 6, wherein the length of each of said first and second conducting strips does not exceed half the wavelength corresponding to the center frequency of said variable phase shifter, and wherein the length of each of said first extension and said second extension does not exceed a quarter of the wavelength corresponding to the center frequency of said variable phase shifter.

8. The variable phase shifter according to claim 1, wherein the ends of said first and second conducting strips are open circuits.

9. The variable phase shifter according to claim 1, wherein the ends of each said first and second conducting strips is short circuited.

10. The variable phase shifter according to claim 1, wherein the width of said first and second conducting strips varies along the length thereof.

11. The variable phase shifter according to claim 1, wherein said coupler is static and said conducting strips move relative to said coupler.

12. The variable phase shifter according to claim 1, wherein a respective one of said first and second conducting strips capacitively coupled with said corresponding one of said through port and said coupled port.

13. The variable phase shifter according to claim 1 further comprising a substrate, wherein said coupler is coupled with said substrate, said substrate provides mechanical support to said coupler.

14. The variable phase shifter according to claim 1, said variable phase shifter being employed in a feeding network of an antenna array, said antenna array including:

a plurality of antennas;

a signal distribution network for distributing the signal to said plurality of antennas, said variable phase shifter being embedded in said signal distribution network.

15. A variable phase shifter array, including at least a first variable phase shifter and a second variable phase shifter, each said first and said second variable phase shifters shifting the phase of an input signal by a phase shift corresponding thereto, each said first and said second variable phase shifters including:

a branch line coupler including an input port, an output port, a through port and a coupled port; and two conducting finite strips exhibiting equal lengths, a first one of the two conducting strips being movably coupled with a first section of said coupler, said first section connecting said input port with said through port and a second one of the two conducting strips being movably coupled with a second section of said coupler, said second section connecting said output port and with said coupled port, wherein displacing said conducting strip relative to said coupler, changes the phase of an output signal from said coupler, relative to the phase of a corresponding input signal into said coupler.

16. The variable phase shifter array according to claim 15, wherein the width of the conducting strips of said first phase shifter is different from the width of the conducting strip of said second phase shifter, such that said first variable phase shifter exhibits a phase shift that is different from the phase shift of said second variable phase shifter for the same amount of displacement of said first variable phase shifter.

17. The variable phase shifter array according to claim 16, wherein the conducting strips of said first variable phase shifter and said second variable phase shifters are displaced by same distance with respect to each other.

18. The variable phase shifter array according to claim 15, wherein the width of the conducting strips of said first phase shifter is equal to the width of the conducting strips of said second phase shifter.

19. The variable phase shifter according to claim 18, wherein the distance of displacement of the conducting strips of each of said variable phase shifters exhibit a proportionality factor there between.

* * * * *